US010900162B2

(12) United States Patent
Leibman et al.

(10) Patent No.: US 10,900,162 B2
(45) Date of Patent: Jan. 26, 2021

(54) PASSIVE DIVERTER FOR AN AUXILIARY SPRAY DEVICE OF A WASHING MACHINE APPLIANCE

(71) Applicant: Haier US Appliance Solutions, Inc., Wilmington, DE (US)

(72) Inventors: Alexander B. Leibman, Prospect, KY (US); Peter Hans Bensel, Louisville, KY (US); Naveena Heddanahally Lakshmegowda, Hassan (IN); Manidhar V V S Yandamuri, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 382 days.

(21) Appl. No.: 15/900,865

(22) Filed: Feb. 21, 2018

(65) Prior Publication Data

US 2019/0257022 A1 Aug. 22, 2019

(51) Int. Cl.

| | |
|---|---|
| ***B05B 1/16*** | (2006.01) |
| ***B05B 1/18*** | (2006.01) |
| ***B05B 1/30*** | (2006.01) |
| ***D06F 5/00*** | (2006.01) |
| ***D06F 23/04*** | (2006.01) |
| ***D06F 29/00*** | (2006.01) |
| ***D06F 39/08*** | (2006.01) |

(52) U.S. Cl.

CPC ..... *D06F 39/083* (2013.01); *B05B 1/1663* (2013.01); *B05B 1/18* (2013.01); *B05B 1/30* (2013.01); *B05B 1/3026* (2013.01); *D06F 5/00* (2013.01); *D06F 23/04* (2013.01); *D06F 29/00* (2013.01); *D06F 39/088* (2013.01)

(58) Field of Classification Search

CPC ..... B05B 1/18; B05B 1/1663; B05B 1/30; B05B 1/3026; D06F 5/00; D06F 23/04; D06F 29/00; D06F 39/083; D06F 39/088

USPC ..... 68/13 R, 205 R; 239/318, 375, 407, 446

See application file for complete search history.

(56) References Cited

U.S. PATENT DOCUMENTS

| | | | |
|---|---|---|---|
| 2,795,460 | A | 6/1957 | Bletcher et al. |
| 3,254,844 | A | 6/1966 | Blasnik et al. |
| 3,341,132 | A | 9/1967 | Parkison |
| 3,341,168 | A | 9/1967 | Toeppen |
| 3,342,419 | A | 9/1967 | Weese |
| 3,422,849 | A | 1/1969 | Manoogian |
| 3,447,753 | A | 6/1969 | Proctor et al. |
| 3,499,440 | A | 3/1970 | Gibbs |
| 3,902,671 | A | 9/1975 | Symmons |

(Continued)

*Primary Examiner* — Levon J Shahinian

(74) *Attorney, Agent, or Firm* — Dority & Manning, P.A.

(57) ABSTRACT

A washing machine appliance includes a diverter assembly for selectively directing a flow of water to a primary dispenser and an auxiliary spray device. The diverter assembly includes a diverter body defining a diverter body defining a chamber inlet, a primary outlet in fluid communication with the primary dispenser, and an auxiliary outlet in fluid communication with the auxiliary spray device. A diverter valve moves between a first and second position based on a pressure differential relative to a diverter chamber. During standard operation, a spring urges the diverter valve to seal the auxiliary outlet and direct the flow to the primary dispenser. When a button is depressed to activate the auxiliary spray device, the pressure differential across the auxiliary outlet urges the diverter valve to a second position that seals the primary outlet and directs the flow to the auxiliary spray device.

20 Claims, 7 Drawing Sheets

(56) References Cited

U.S. PATENT DOCUMENTS

| | | | |
|---|---|---|---|
| 4,008,732 | A | 2/1977 | Fichter et al. |
| 4,117,979 | A | 10/1978 | Lagarelli et al. |
| 4,573,639 | A | 3/1986 | Logue |
| 5,246,169 | A | 9/1993 | Heimann et al. |
| 5,806,771 | A | 9/1998 | Loschelder et al. |
| 5,918,811 | A | 7/1999 | Denham et al. |
| 5,996,603 | A | 12/1999 | Dupler |
| 6,345,773 | B1 | 2/2002 | Shanklin et al. |
| 7,077,153 | B2 | 7/2006 | Segien, Jr. |
| 2016/0102425 | A1 | 4/2016 | Scheckelhoff |

PASSIVE DIVERTER FOR AN AUXILIARY SPRAY DEVICE OF A WASHING MACHINE APPLIANCE

FIELD OF THE INVENTION

The present subject matter relates generally to washing machine appliances and more particularly to washing machine appliances having auxiliary spray devices.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc.

During operation of certain washing machine appliances, a volume of wash fluid is directed into the tub in order to wash and/or rinse articles within the wash chamber. More specifically, a predetermined volume of wash fluid is typically provided through a primary dispenser positioned at a back wall of the washing machine appliance. However, in certain situations, a user may wish to have additional wash fluid dispensed into the tub and/or may wish to direct the flow of wash fluid onto a particular garment or within a specific region of the wash tub, e.g., to perform a pretreating operation or to saturate a particular article of clothing. The ability to adjust the amount and dispensing location of wash fluid is a commercially desirable feature and increases the user's positive perception of the wash process generally. However, conventional auxiliary spray devices require a dedicated fluid supply, complex plumbing configurations, and/or costly diverter assemblies.

Accordingly, a washing machine appliance including an auxiliary spray device is desirable. In particular, a simple, low cost diverter assembly for selectively distributing wash fluid between a primary nozzle and an auxiliary spray device would be particularly beneficial.

BRIEF DESCRIPTION OF THE INVENTION

The present subject matter provides a washing machine appliance including a diverter assembly for selectively directing a flow of water to a primary dispenser and an auxiliary spray device. The diverter assembly includes a diverter body defining a chamber inlet, a primary outlet in fluid communication with the primary dispenser, and an auxiliary outlet in fluid communication with the auxiliary spray device. A diverter valve moves between a first and second position based on a pressure differential relative to a diverter chamber. During standard operation, a spring urges the diverter valve to seal the auxiliary outlet and direct the flow to the primary dispenser. When a button is depressed to activate the auxiliary spray device, the pressure differential across the auxiliary outlet urges the diverter valve to a second position that seals the primary outlet and directs the flow to the auxiliary spray device. Additional aspects and advantages of the invention will be set forth in part in the following description, or may be apparent from the description, or may be learned through practice of the invention.

In one exemplary embodiment, a washing machine appliance including a cabinet including a top panel and a wash tub positioned within the cabinet and defining a wash chamber for receipt of articles for washing. A wash basket is rotatably mounted within the wash tub and a diverter assembly is configured for selectively directing a flow of water to a primary dispenser and an auxiliary spray device. The diverter assembly includes a diverter body defining a chamber inlet, a primary outlet in fluid communication with the primary dispenser, and an auxiliary outlet in fluid communication with the auxiliary spray device. A diverter valve includes a primary seal and an auxiliary seal positioned on a diverter shaft, wherein the diverter valve is movable between a first position where the auxiliary seal blocks the auxiliary outlet to direct the flow of water to the primary dispenser and a second position where the primary seal blocks the primary outlet to direct the flow of water to the auxiliary spray device.

In another exemplary embodiment, a diverter assembly for selectively directing a flow of fluid to a primary dispenser and an auxiliary spray device within a washing machine appliance. The diverter assembly includes a diverter body defining a chamber inlet, a primary outlet in fluid communication with the primary dispenser, and an auxiliary outlet in fluid communication with the auxiliary spray device. A diverter valve includes a primary seal and an auxiliary seal positioned on a diverter shaft, wherein the diverter valve is movable between a first position where the auxiliary seal blocks the auxiliary outlet to direct the flow of water to the primary dispenser and a second position where the primary seal blocks the primary outlet to direct the flow of water to the auxiliary spray device.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
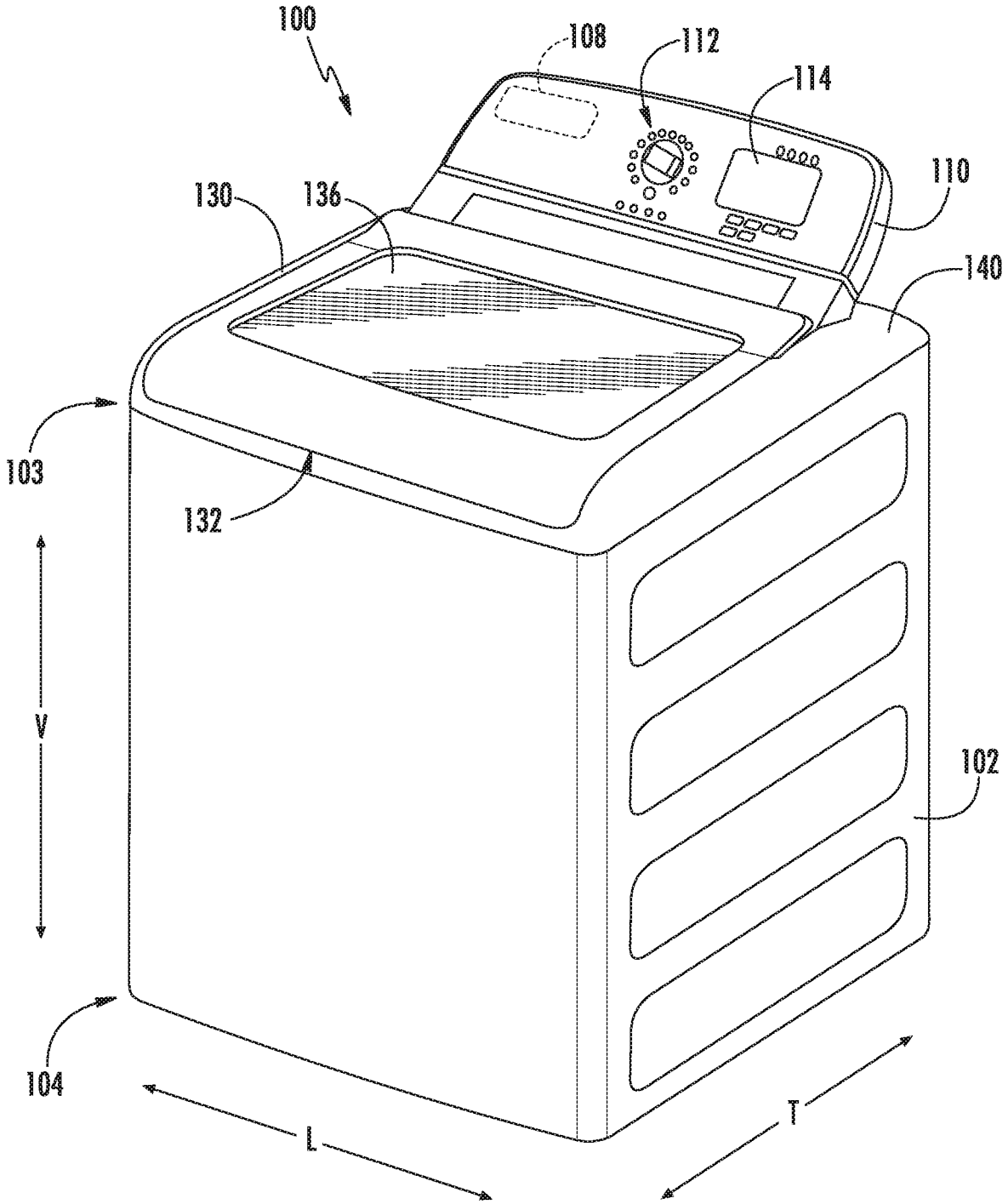
FIG. 1 provides a perspective view of a washing machine appliance according to an exemplary embodiment of the present subject matter with a door of the exemplary washing machine appliance shown in a closed position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
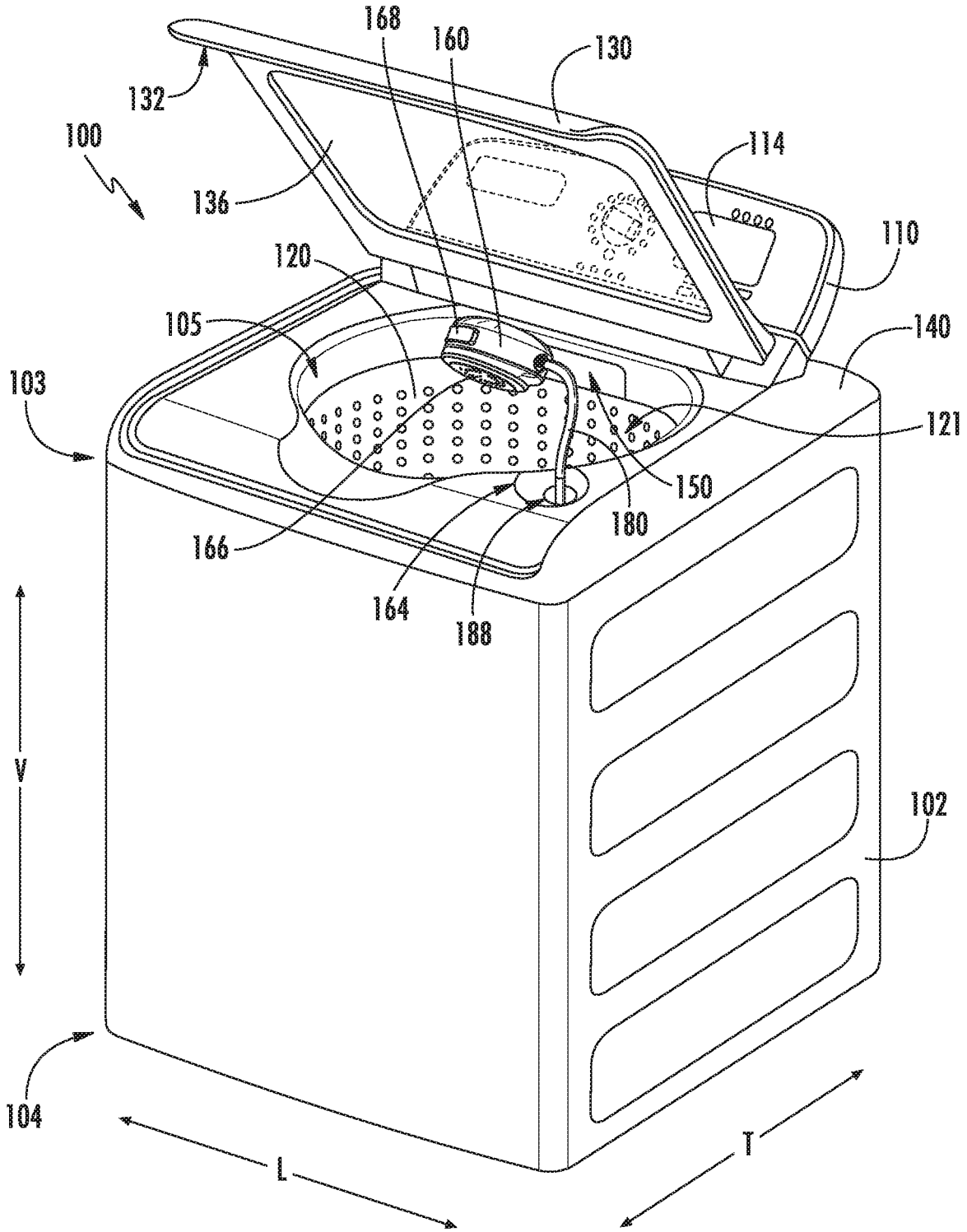
FIG. 2 provides a perspective view of the exemplary washing machine appliance of FIG. 1 with the door of the exemplary washing machine appliance shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top portion 103 and a bottom portion 104 along the vertical direction V. A wash basket 120 (FIG. 2) is rotatably mounted within cabinet 102. A motor (not shown) is in mechanical communication with wash basket 120 to selectively rotate wash basket 120 (e.g., during an agitation or a rinse cycle of washing machine appliance 100). Wash basket 120 is received within a wash tub or wash chamber 121 (FIG. 2) and is configured for receipt of articles for washing. The wash tub 121 holds wash and rinse fluids for agitation in wash basket 120 within wash tub 121. An agitator or impeller (not shown) extends into wash basket 120 and is also in mechanical communication with the motor. The impeller assists agitation of articles disposed within wash basket 120 during operation of washing machine appliance 100.

Cabinet 102 of washing machine appliance 100 has a top panel 140. Top panel 140 defines an opening 105 (FIG. 2) that permits user access to wash basket 120 of wash tub 121. Door 130, rotatably mounted to top panel 140, permits selective access to opening 105; in particular, door 130 selectively rotates between the closed position shown in FIG. 1 and the open position shown in FIG. 2. In the closed position, door 130 inhibits access to wash basket 120. Conversely, in the open position, a user can access wash basket 120. A window 136 in door 130 permits viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any other suitable support.

A control panel 110 with at least one input selector 112 (FIG. 1) extends from top panel 140. Control panel 110 and input selector 112 collectively form a user interface input for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device 108 (FIG. 1) that is operatively coupled to control panel 110 for user manipulation to select washing machine cycles and features. In response to user manipulation of control panel 110, controller 108 operates the various components of washing machine appliance 100 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

During operation of washing machine appliance 100, laundry items are loaded into wash basket 120 through opening 105, and washing operation is initiated through operator manipulation of input selectors 112. Wash basket 120 is filled with water and detergent and/or other fluid additives via a primary dispenser (see FIG. 2). One or more valves can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash basket 120 through opening 105.

Figure 3:
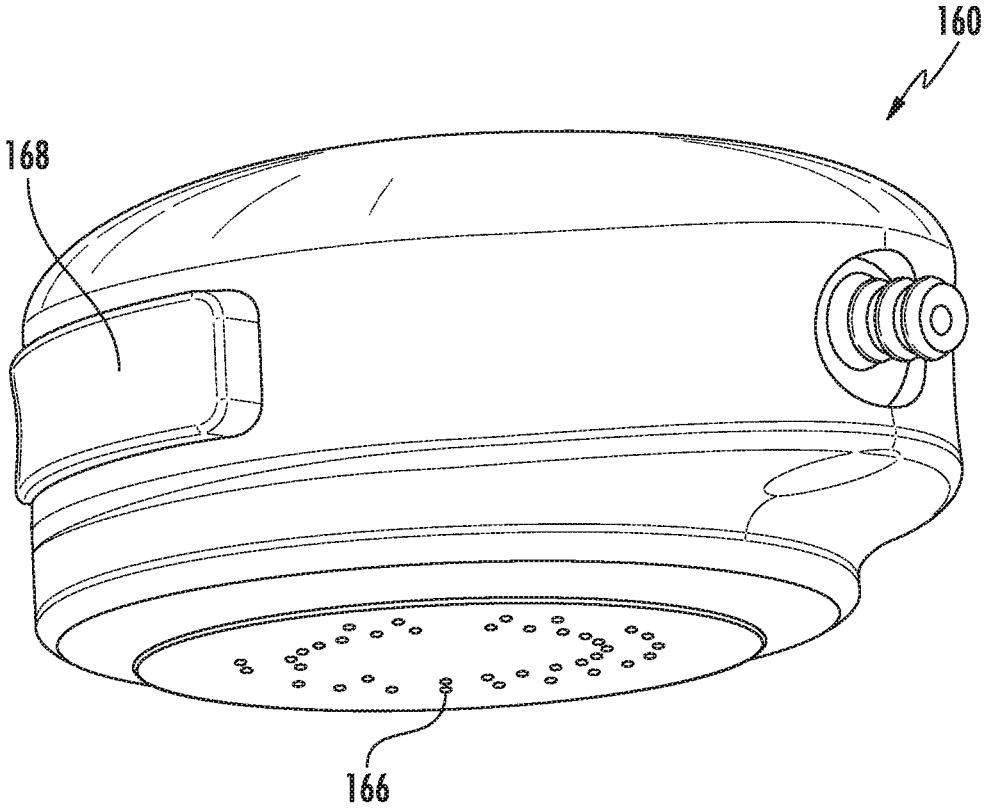
FIG. 3 provides a perspective view of an auxiliary spray device for use with the exemplary washing machine appliance of FIG. 1 according to an exemplary embodiment of the present subject matter.
Figure 4:
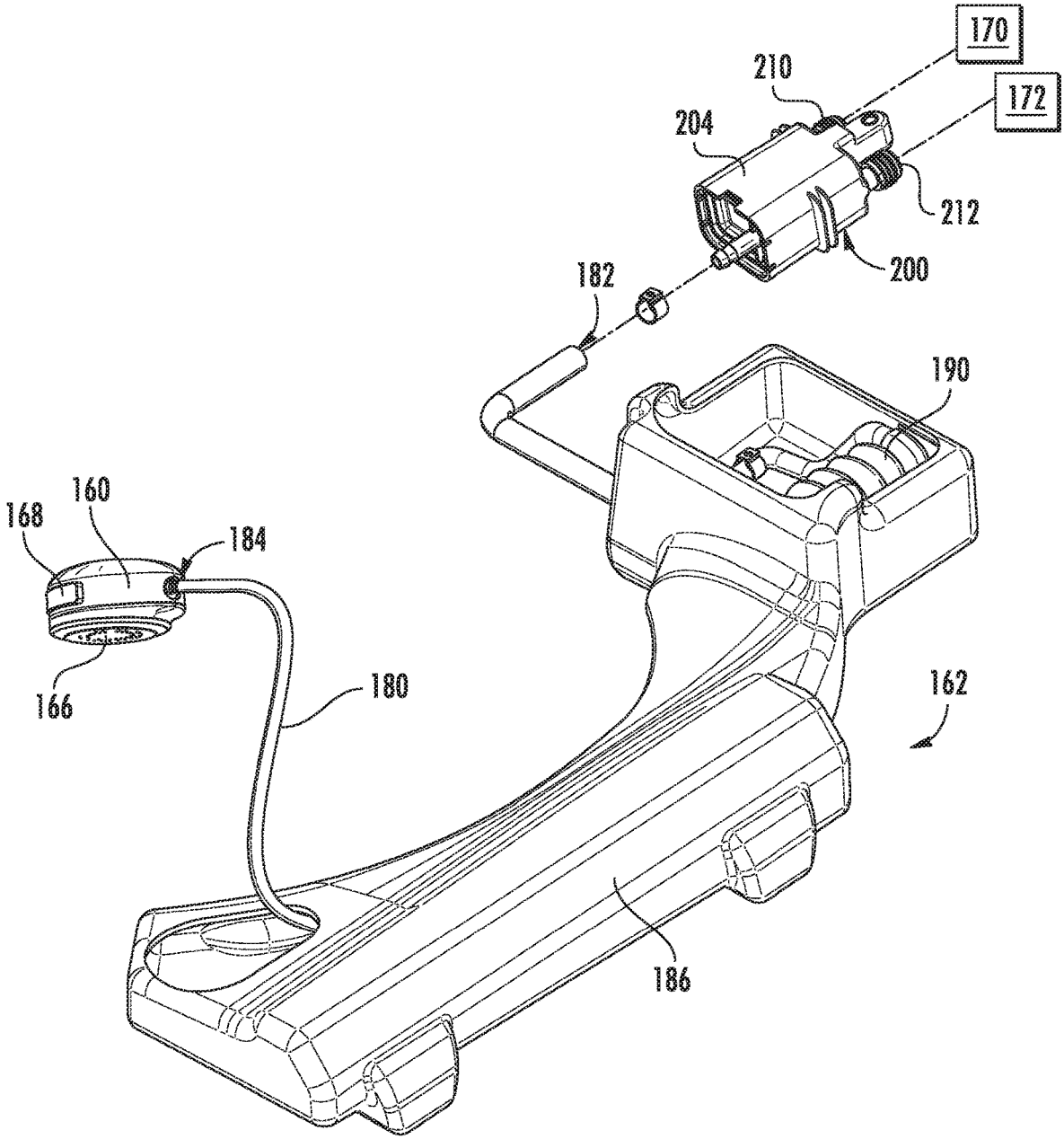
FIG. 4 provides a perspective view of a diverter assembly and hose assembly for providing a flow of wash fluid to the exemplary spray device of FIG. 3 according to an exemplary embodiment of the present subject matter.

Referring now generally to FIGS. 2 through 4, an auxiliary spray device 160 and a hose assembly 162 for providing a flow of wash fluid to auxiliary spray device will 160 be described in more detail according to an exemplary embodiment. Auxiliary spray device 160 is generally configured for providing a flow of wash fluid into wash tub 121. More specifically, according to the illustrated exemplary embodiment, auxiliary spray device 160 is positioned within top panel 140 or another easily accessible location for a user when door 130 is in the open position. According to an exemplary embodiment, top panel 140 may define a docking station 164 for receiving auxiliary spray device 160 when not in use. In this manner, door 130 may be closed when auxiliary spray device 160 is not in use and is positioned within docking port 164.

According to the illustrated embodiment, auxiliary spray device 160 is generally configured for directing the flow of wash fluid in the desired direction, generating the desired spray pattern, or otherwise stopping and starting the flow of wash fluid. For example, auxiliary spray device 160 may define a plurality of spray ports 166 configured for discharging a flow of wash fluid in the desired pattern. Auxiliary spray device 160 may further include a button 168 that is operably coupled with auxiliary spray device 160 such that auxiliary spray device 160 is configured for discharging wash fluid when button 168 is pressed.

Figure 8:
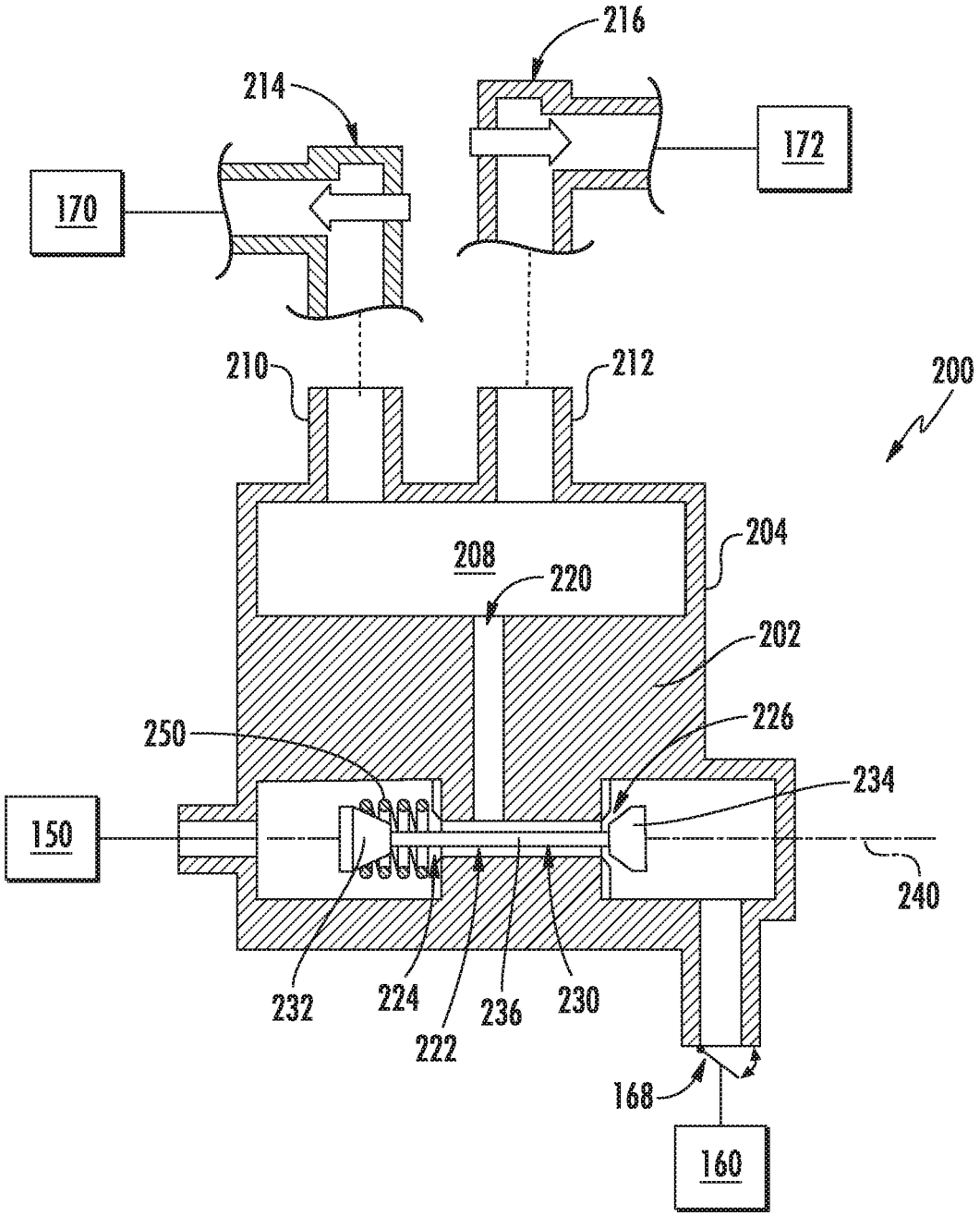
FIG. 8 provides a schematic view of the exemplary diverter assembly of FIG. 4 according to an exemplary embodiment of the present subject matter.

Button 168 may be any button or switch suitable for actuating diverter assembly 200 (as described below). For example, as illustrated in FIG. 8, button 168 is depicted as a normally closed valve that is opened when depressed. Button 168 may alternatively be a push button switch, a toggle switch, a rocker switch, or any other suitable tactile switch, such as a capacitive touch buttons configured for regulating a flow of wash fluid. Moreover, according to an exemplary embodiment, auxiliary spray device 160 may be configured to provide a flow of wash fluid when removed from the docking station 164.

According to the illustrated embodiment, button 168 is located on auxiliary spray device 160. However, according to alternative embodiments, button 168 may be mounted on control panel 110 of washing machine appliance 100, e.g., button 168 may be one of input selectors 112. During operation, a user may wish to add additional water to wash tub 121, e.g., to prewash one or more articles of clothing or due to a perceived need for more water to effectively wash a load. The user may actuate auxiliary spray device 160 using button 168 to supply such wash fluid or water.

According to the exemplary embodiment, auxiliary spray device 160 is configured for supplying a flow of water mixed from a cold water supply 170 and a hot water supply 172, such as an external or mains water supplies, as will be described in detail below. However, it should be appreciated that aspects of the present subject matter may be used to provide a flow of any suitable wash fluid to primary dispenser 150 and auxiliary spray device 160. For example, auxiliary spray device 160 may be configured for receiving a flow of pretreatment liquid, wash detergent, fabric softener, stain remover, or any other suitable wash fluid.

As illustrated, hose assembly 162 generally includes a semi-rigid or flexible hose 180 that supplies water to auxiliary spray device 160. Flexible hose 180 is generally any fluid conduit that extends from a fluid supply to a location suitable for discharging wash fluid into wash tub 121. In this regard, for example, flexible hose 180 may include a hose inlet 182 and a hose outlet 184. Hose inlet 182 is fluidly coupled to a diverter assembly 200 (described below) for receiving a flow of wash fluid. According to an exemplary embodiment, flexible hose 180 may be constructed from any suitably flexible conduit, such as vinyl or rubber.

Flexible hose 180 is positioned at least in part within a hose housing 186. Hose housing 186 may be, for example, constructed from rigid plastic (e.g., via injection molding) and configured for being positioned underneath top panel 140. More specifically, hose housing 186 can be positioned within a cavity defined by top panel 140 and between a sidewall of cabinet 102 and opening 105 of wash tub 121. Moreover, hose housing 186 is contoured to match the shape of opening 105. Hose housing 186 may be mounted to top panel 140 using any suitable mechanical fastener, such as screws, bolts, rivets, etc. Similarly, glue, bonding, snap-fit mechanisms, interference-fit mechanisms, or any suitable combination thereof be used to join hose housing 186 to top panel 140.

In the extended position, flexible hose 180 may exit hose housing 186 and extend toward wash tub 121 for selectively providing wash fluid into wash tub 121 or onto an article of clothing, e.g., via auxiliary spray device 160. For example, according to the illustrated embodiment, flexible hose 180 passes out of hose housing 186 through an aperture 188 defined in top panel 140. In the retracted position, hose outlet 184 of flexible hose 180 may extend slightly out of aperture 188 for easy access and may be pulled toward wash tub 121. According to alternative embodiments, hose outlet 184 of flexible hose 180 may exit hose housing 186, e.g., from a hole in the side of hose housing 186 and extend between top panel 140 and wash tub 121 or may exit at any other suitable location. Hose outlet 184 may be coupled to auxiliary spray device 160 using any suitable fluid coupling mechanism or device.

Hose assembly 162 may further include a retraction mechanism 190 mounted within hose housing 186 for urging flexible hose 180 toward a retracted position when not in use. More specifically, referring to FIG. 4, retraction mechanism 190 is a resilient coil defined by flexible hose 180. The resilient coil generally urges flexible hose 180 into a retracted position and auxiliary spray device 160 back toward docking station 164. Specifically, in operation, a user may pull on auxiliary spray device 160 such that retraction mechanism 190 (e.g., coiled hose) extends to permit a user to dispense wash fluid where desired. After the user is finished using auxiliary spray device 160 for providing wash fluid into wash tub 121, the user may release auxiliary spray device 160 and the resiliency in flexible hose 180 may draw flexible hose 180 back into hose housing 186 and into the retracted position. However, according to alternative embodiments, retraction mechanism 190 may be a torsional spring (e.g., such as commonly used in a tape measure), a linear spring, a weighted loop, a coiling/winding mechanism, or any other suitable mechanism for retracting flexible hose 180.

Referring now generally to FIGS. 4 through 8, diverter assembly 200 will be described in more detail according to an exemplary embodiment. According to the illustrated embodiment, diverter assembly 200 is configured for selectively directing a flow of water to primary dispenser 150 or auxiliary spray device 160. However, it should be appreciated that diverter assembly 200 could alternatively be used to direct a flow of any suitable wash fluid between any two or more spray devices or discharge ports in any suitable appliance. Other configurations are possible and within the scope of the present subject matter.

Diverter assembly 200 generally includes a diverter body 202 positioned within a diverter sleeve or outer housing 204. In this regard, diverter body 202 may slide into outer housing 204 and one or more seals, such as O-rings 206 may be positioned between diverter body 202 and outer housing 204 to prevent leaks from one or more chambers within diverter assembly 200. Specifically, diverter assembly 200 may include a mixing manifold 208 that is defined in part by diverter body 202 and in part by outer housing 204. Outer housing 204 defines a cold water inlet 210 in the hot water inlet 212 that are fluidly coupled with cold water supply 170 and hot water supply 172, respectively, e.g., via suitable fluid conduits.

In addition, as best shown schematically in FIG. 8, cold water supply 170 may be operably coupled with a cold water solenoid valve 214 for controlling the flow of cold water through cold water inlet 210 in a hot water solenoid valve 216 for controlling the flow of hot water through hot water inlet 212. In this manner, flows of cold water and hot water are provided into mixing manifold 208 in desired proportions and are mixed together to form a flow of water having a desired temperature.

Figure 5:
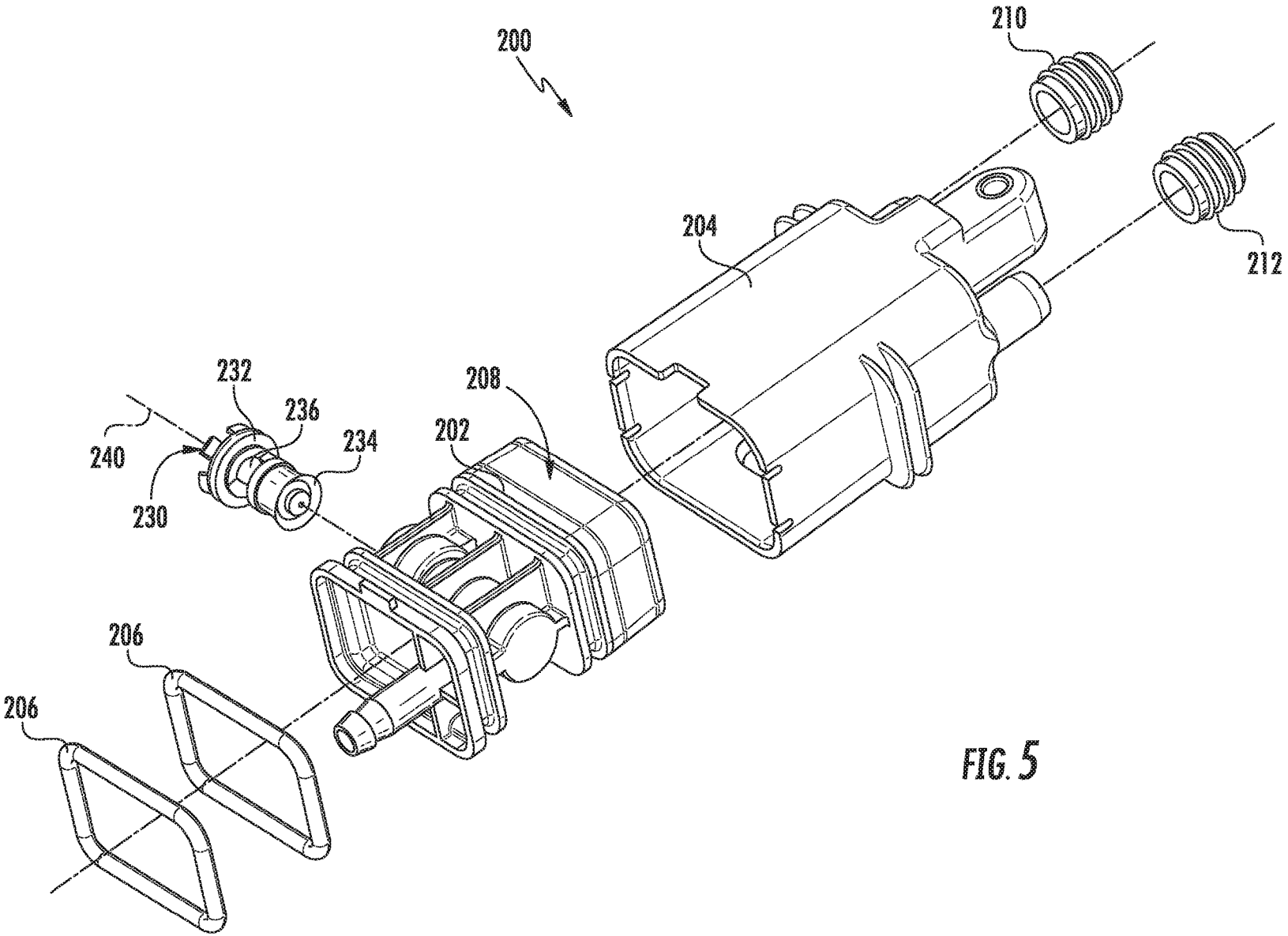
FIG. 5 provides an exploded view of the exemplary diverter assembly of FIG. 4 according to an exemplary embodiment of the present subject matter.
Figure 6:
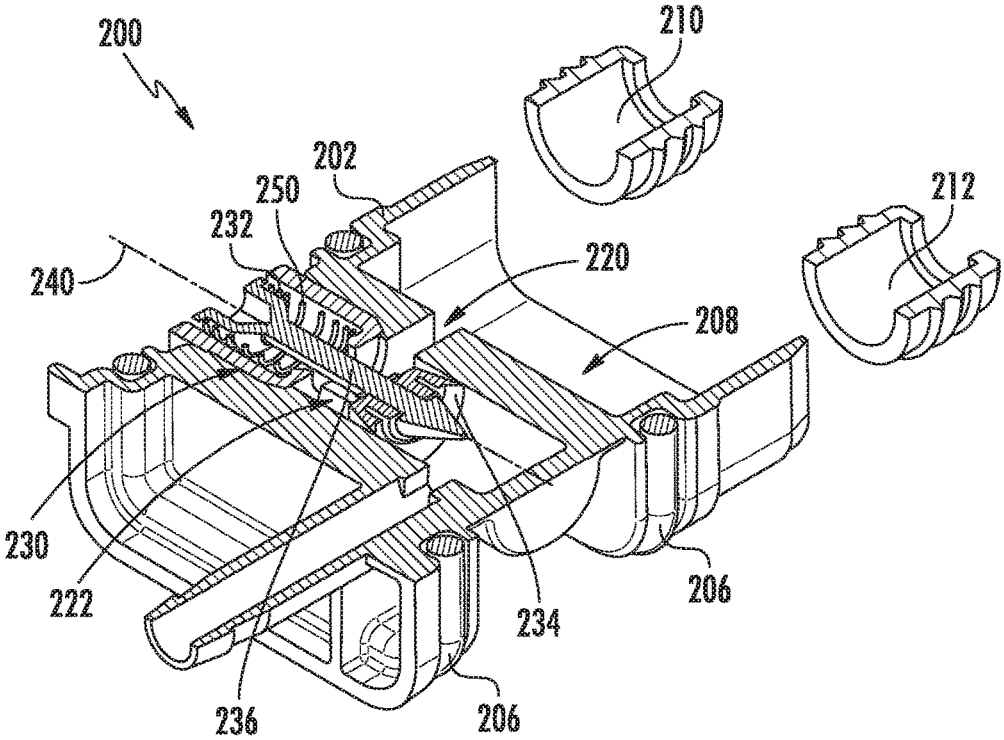
FIG. 6 provides a cross sectional view of the exemplary diverter assembly of FIG. 4 according to an exemplary embodiment of the present subject matter.
Figure 7:
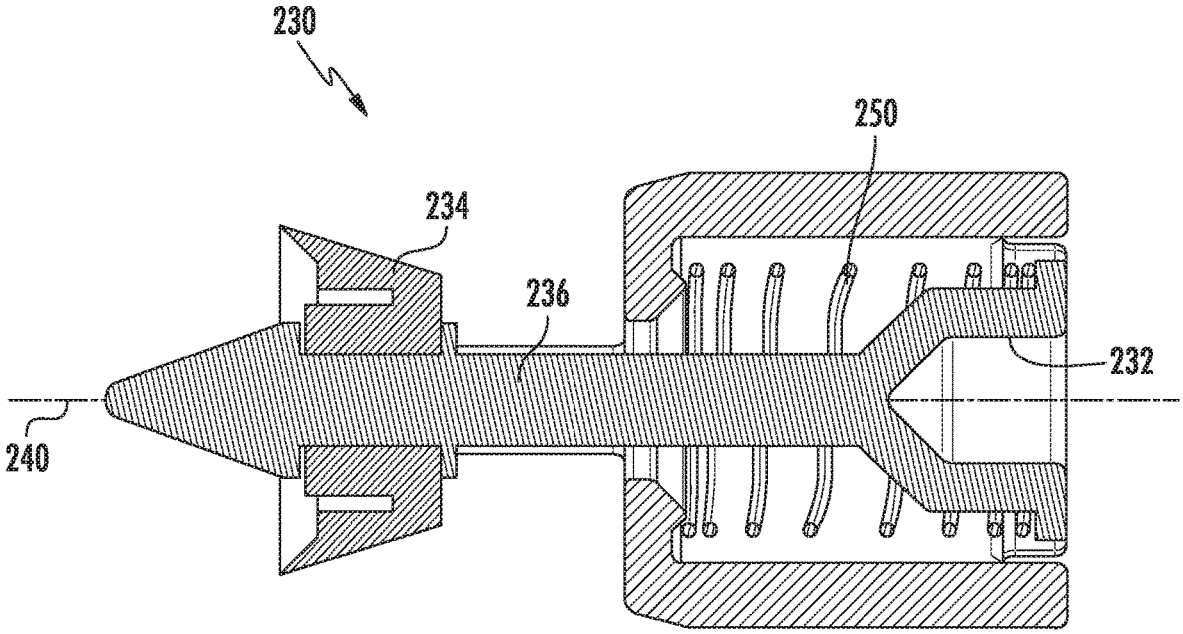
FIG. 7 provides a cross sectional view of a diverter valve for use with the exemplary diverter assembly of FIG. 4.

As best shown in FIGS. 5, 6, and 8, diverter body 202 further defines a chamber inlet 220 positioned downstream from mixing manifold 208 and a diverter chamber 222. The flow of water thus passes from mixing manifold 208 through chamber inlet 220 and into diverter chamber 222 before being routed either to primary dispenser 150 or auxiliary spray device 160, as described in more detail below. Diverter body 202 further defines a primary outlet 224 that is in fluid communication with primary dispenser 150 and an auxiliary outlet 226 that is in fluid communication with auxiliary spray device 160.

Diverter assembly 200 further includes a diverter valve 230 that is positioned within diverter body 202 and is generally configured for directing the flow of water to primary outlet 224 or auxiliary outlet 226. Notably, diverter valve 230 is described herein as directing the entire flow of water to one or the other outlets 224, 226. However, it should be appreciated that according to alternative embodiments, diverter valve 230 may be configured for directing portions of the total flow of water between two or more outlets.

According to the illustrated embodiment, diverter valve 230 includes a primary seal 232 and an auxiliary seal 234 positioned on opposite ends of a diverter shaft 236. More specifically, primary seal 232 is positioned proximate primary outlet 224 and auxiliary seal 234 is positioned proximate auxiliary outlet 226. In operation, diverter valve 230 is movable between a first position (e.g., as shown in FIGS. 6 and 8) where auxiliary sealed 234 blocks auxiliary outlet 226 such that the flow of water is directed out primary outlet 224 to primary dispenser 150 and a second position where primary seal 232 blocks primary outlet 224 such that the flow of water is directed out auxiliary outlet 226 to auxiliary spray device 160.

As best shown in FIG. 8, diverter shaft 236 defines a longitudinal axis 240 and movement between the first position and the second position involves diverter shaft 236 translating along its longitudinal axis 240. Specifically, diverter shaft 236 extends through diverter chamber 222 between primary seal 232 and auxiliary seal 234. In this regard, diverter valve 230 generally defines valve length that is longer than a length of the diverter chamber measured along the longitudinal axis 240.

According to the illustrated embodiment, primary seal 232 and auxiliary seal 234 are both resilient conical washers positioned at opposite distal ends of diverter shaft 236. Moreover, primary seal 232 and auxiliary seal 236 are positioned on diverter shaft 236 outside of diverter chamber 222. Diverter body 202 may define primary outlet 224 and auxiliary outlet 226 to have complementary shapes to primary seal 232 and auxiliary seal 236, respectively, to enhance the sealing effect.

Diverter valve 230 may be actuated, i.e., moved between the first position and the second position, using any suitable mechanical actuator or device. According to the illustrated embodiment, diverter assembly 200 is a passive diverter assembly that eliminates the need for costly sensors, solenoids, or other electronics. In this regard, for example, diverter valve 230 may be actuated or moved from the first position to the second position by depressing button 168 on auxiliary spray device 160. Pressing button 168 creates a pressure differential within diverter body 202 which generally urges diverter valve 230 to the second position, e.g., such that the flow of water is directed towards auxiliary spray device 160. Although button 168 described herein as actuating diverter valve 230, it should be appreciated that any other suitable actuation mechanism may be used according to alternative embodiments.

Notably, according to the exemplary embodiment described herein, diverter assembly 200 operates based on pressure differentials within diverter body 202. More specifically, primary dispenser 150 and auxiliary spray device 160 may generally be exposed to similar atmospheric pressures. Therefore, when button 168 is pressed such that auxiliary spray device 160 is opened atmospheric pressure, diverter valve 230 experiences a substantially equivalent pressure differential across primary outlet 224 and auxiliary outlet 226. Therefore according to the illustrated embodiment, diverter valve 230 may further include a spring element 250, such as a coiled mechanical spring, that urges diverter valve 230 toward the first position. It should be appreciated that as used herein, terms of approximation, such as "approximately," "substantially," or "about," refer to being within a ten percent margin of error.

In operation, depressing button 168 opens auxiliary outlet to atmospheric pressure, thereby generating a pressure differential across auxiliary outlet 226 that is sufficient for overcoming the spring force exerted by spring element 250 and moving diverter valve 230 to the second position such that the flow of water goes to the auxiliary spray device 160. By contrast, when button 168 is not pressed, e.g., the pressure differential across primary outlet 224 (along with the spring force of spring element 250) urges diverter valve 230 to the first position such that the flow of water goes to primary dispenser 150.

Although the discussion herein refers to auxiliary spray device 160 for dispensing a flow of water, one skilled in the art will appreciate that the features and configurations described may be used for other nozzle assemblies and spray devices to supply other wash fluids in other washing machine appliances. In addition, as used herein, "wash fluid" may refer to water, detergent, fabric softener, bleach, or any other suitable wash additive or combination thereof. For example, auxiliary spray device 160 may be positioned on a front of cabinet 102, may have a different shape or actuation mechanism, and may supply wash fluid, detergent, or other additives. Other variations and modifications of the exemplary embodiment described below are possible, and such variations are contemplated as within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet including a top panel;

a wash tub positioned within the cabinet and defining a wash chamber for receipt of articles for washing;

a wash basket rotatably mounted within the wash tub; and a diverter assembly configured for selectively directing a flow of water to a primary dispenser and an auxiliary spray device, the diverter assembly comprising:

a diverter body defining a chamber inlet, a primary outlet in fluid communication with the primary dispenser, and an auxiliary outlet in fluid communication with the auxiliary spray device;

a diverter valve comprising a primary seal and an auxiliary seal positioned on a diverter shaft, wherein the diverter valve is movable between a first position where the auxiliary seal blocks the auxiliary outlet to direct the flow of water to the primary dispenser and a second position where the primary seal blocks the primary outlet to direct the flow of water to the auxiliary spray device; and a spring element that urges the diverter valve to the first position.

2. The washing machine appliance of claim 1, wherein the diverter shaft defines a longitudinal axis, wherein the diverter shaft translates along the longitudinal axis between the first position and the second position.

3. The washing machine appliance of claim 1, wherein the primary seal and the auxiliary seal are resilient conical washers positioned on opposite ends of the diverter shaft.

4. The washing machine appliance of claim 3, wherein the diverter shaft extends through a diverter chamber between the auxiliary seal and the primary seal.

5. The washing machine appliance of claim 1, wherein the diverter assembly further comprises:

a mixing manifold in fluid communication with a hot water inlet and a cold water inlet, the mixing manifold positioned upstream of the chamber inlet for mixing hot and cold water.

6. The washing machine appliance of claim 1, wherein the diverter valve is moved from the first position to the second position by depressing a button positioned on the auxiliary spray device.

7. The washing machine appliance of claim 6, wherein depressing the button opens the auxiliary outlet to atmospheric pressure, generating a pressure differential across the auxiliary outlet sufficient to move the diverter valve to the second position.

8. The washing machine appliance of claim 7, wherein the pressure differential is large enough to overcome the spring element that biases the diverter valve toward the first position.

9. The washing machine appliance of claim 1, wherein the auxiliary spray device is a handheld spray nozzle extending from the top panel.

10. The washing machine appliance of claim 1, wherein a flexible hose fluidly couples the auxiliary outlet to the auxiliary spray device.

11. The washing machine appliance of claim 10, wherein the flexible hose is operably coupled to a retraction mechanism for managing the flexible hose as auxiliary spray device is moved to and from a docking station in the top panel.

12. A diverter assembly for selectively directing a flow of fluid to a primary dispenser and an auxiliary spray device within a washing machine appliance, the diverter assembly comprising:

a diverter body defining a chamber inlet, a primary outlet in fluid communication with the primary dispenser, and an auxiliary outlet in fluid communication with the auxiliary spray device;

a diverter valve comprising a primary seal and an auxiliary seal positioned on a diverter shaft, wherein the diverter valve is movable between a first position where the auxiliary seal blocks the auxiliary outlet to direct the flow of water to the primary dispenser and a second position where the primary seal blocks the primary outlet to direct the flow of water to the auxiliary spray device; and a spring element that urges the diverter valve to the first position.

13. The diverter assembly of claim 12, wherein the diverter shaft defines a longitudinal axis, wherein the diverter shaft translates along the longitudinal axis between the first position and the second position.

14. The diverter assembly of claim 12, wherein the primary seal and the auxiliary seal are resilient conical washers positioned on opposite ends of the diverter shaft.

15. The diverter assembly of claim 12, wherein the diverter assembly further comprises:

a mixing manifold in fluid communication with a hot water inlet and a cold water inlet, the mixing manifold positioned upstream of the chamber inlet for mixing hot and cold water.

16. The diverter assembly of claim 12, wherein the diverter valve is moved from the first position to the second position by depressing a button positioned on the auxiliary spray device.

17. The diverter assembly of claim 16, wherein depressing the button opens the auxiliary outlet to atmospheric pressure, generating a pressure differential across the auxiliary outlet sufficient to move the diverter valve to the second position.

18. The diverter assembly of claim 17, wherein the pressure differential is large enough to overcome the spring element that biases the diverter valve toward the first position.

19. A diverter assembly for selectively directing a flow of fluid to a primary dispenser and an auxiliary spray device within a washing machine appliance, the diverter assembly comprising:

a diverter body defining a chamber inlet, a primary outlet in fluid communication with the primary dispenser, and an auxiliary outlet in fluid communication with the auxiliary spray device; and a diverter valve comprising a primary seal and an auxiliary seal, the primary seal and the auxiliary seal being resilient conical washers positioned on opposite ends of a diverter shaft, wherein the diverter valve is movable between a first position where the auxiliary seal blocks the auxiliary outlet to direct the flow of water to the primary dispenser and a second position where the primary seal blocks the primary outlet to direct the flow of water to the auxiliary spray device.

20. The diverter assembly of claim 19, wherein diverter valve further comprises a spring element that urges the diverter valve to the first position.

* * * * *